United States Patent [19]

Grigorenko et al.

[11] 4,030,336

[45] June 21, 1977

[54] HYDRAULIC PROTECTION DEVICE FOR PRESSES

[76] Inventors: Anatoly Sergeevich Grigorenko, ulitsa Tovstukho, 1, kv. 21; Jury Antonovich Moroz, ulitsa Fugenfirova, 11, kv. 91; Vladimir Vladislavovich Landyshev, ulitsa 50 let komsomola, 14-a, kv. 22, all of Omsk, U.S.S.R.

[22] Filed: July 9, 1976

[21] Appl. No.: 703,850

[52] U.S. Cl. ..... 72/432; 83/543; 100/53

[51] Int. Cl.[2] ..... B21J 9/02

[58] Field of Search ..... 72/432; 100/53; 82/543

[56] References Cited

UNITED STATES PATENTS

| | | | |
|---|---|---|---|
| 2,616,543 | 11/1952 | Danly | 100/53 |
| 2,681,703 | 6/1954 | Croucher | 83/543 |
| 2,937,733 | 5/1960 | Danly | 100/53 |
| 3,481,171 | 12/1969 | Alexander | 72/432 |
| 3,583,201 | 6/1971 | Topaz | 72/432 |
| 3,955,396 | 5/1976 | Carrieri | 72/432 |

*Primary Examiner*—C.W. Lanham
*Assistant Examiner*—Gene P. Crosby
*Attorney, Agent, or Firm*—Fleit & Jacobson

[57] ABSTRACT

Hydraulic overload protection device for a press comprises a housing receiving therein a piston defining with this housing a space communicating via a check valve with a supply source and via a relief valve with a drain. This space additionally communicates with the drain via a line including an adjustable relief valve and a device for disconnecting the said space from the drain, when the movable member of the press, carrying a die, has been driven through the maximum length of its stroke. The disclosed protection device offers fine adjustment of the pressing or stamping effort and prolongs the service life of dies.

2 Claims, 1 Drawing Figure

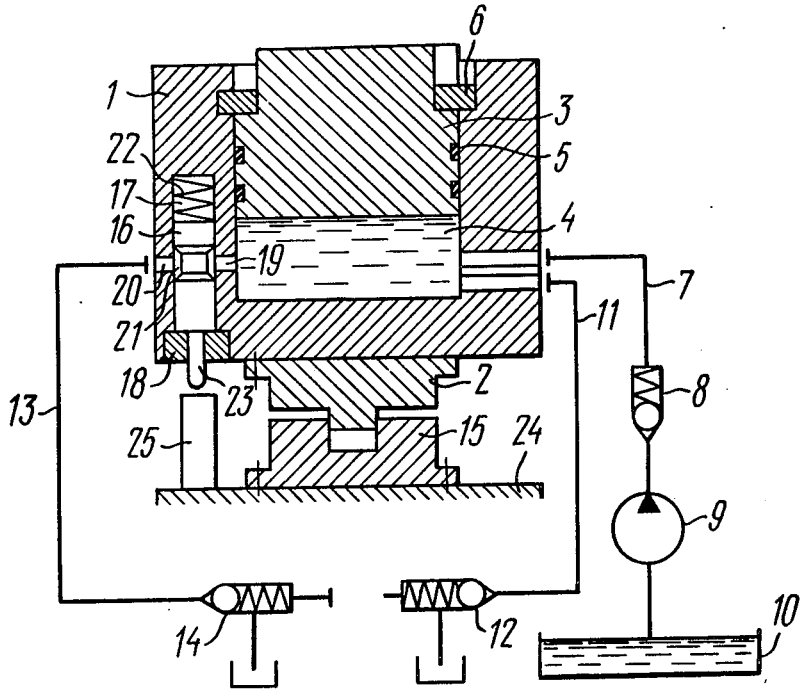
6
1
3
22
5
17
16
4
19
20
7
21
11
18
23
2
8
13
25
15
24
9
14
12
10

HYDRAULIC PROTECTION DEVICE FOR PRESSES

The present invention relates to working metals by application of pressure thereto, and, more particularly, it relates to hydraulic overload protection devices for presses.

It is most expedient that a hydraulic protection device according to the present invention should be used in screw-type press hammers, friction and crank presses.

Known in the art are hudraulic overload protection devices for presses, comprising a housing accommodating therein a pistion.

The pistion and the housing define a space filled with the working liquid and communicated via a check valve with a source of this working liquid, and also communicating via pressure-relief or safety valves with the drain, upon the movable member of the press, carrying the die, having been driven through the maximum length of its working stroke.

The hitherto known protection device is rated for the critical load of the press, i.e. for the load surpassing the rated load of the press, and is intended to protect from overloads the components of the press taking up the efferts produced by the pressing or stamping operation.

When precision-pressing is performed in closed die sets in presses incorporating the above-described protection devices, the energy and the effort of the pressing have to be adjusted.

In shop practice, to produce a stamping of an accurate size, the pressing or stamping operation is performed with a surplus amount of energy.

The energy created by the movable members of the press is influenced by a number of factors, including the degree of friction in the guideways, supply voltage variations, etc.

In some cases it results in overloads, and, hence, in the reduction of the service life of the dies.

It is an object of the present invention to provide a hydraulic overload protection device for a press, which should be of a structure providing for fine adjustment of the stamping or pressing effort.

It is another object of the present invention to step up the accuracy of the dimensions of the pressed or stamped work.

It is still another object of the present invention to prolong the service life of dies and similar tools used in the press.

These and other objects are accomplished in a hydraulic overload protection device for a press, having a housing accommodating therein a piston defining with this housing a space communicating via a check valve with a source of a liquid and also communicating with the drain via a relief valve, upon the movable member of the press, carrying thereon a die, having been driven through the maximum length of its stroke, in which protection device, in accordance with the present invention, the said space defined by the piston and the housing additionally communicates with the drain through a line including an adjustable relief valve and a device for disconnecting the said space from the drain upon the movable member of the press, carrying the die, having been driven through the maximum length of its stroke.

It is expedient that the device for disconnecting the space defined by the housing and the piston from the drain should comprise a slide valve member with an annular groove, mounted in a cylindrical space provided in the housing and communicating via respective passages with the space defined by the piston and the housing with the said line, one end of this slide valve being spring-urged, and the other end thereof carrying a rod adapted to engage a stationary abutment upon the movable member of the press, carrying the die, having been driven through the maximum length of its stroke.

The above-specified structure of the device for disconnecting the said space is simple both in design and manufacture, and also reliable in operation.

Given below is a description of an embodiment of the present invention, with reference being had to the accompanying drawing showing a longitudinally sectional schematic view of a hydraulic protection device constructed in accordance with the invention.

In the drawing, the hydraulic protection device includes a housing 1 which in the presently described embodiment is the slide, i.e. the reciprocating member of the press carrying a die, i.e. the upper die 2 of a die set.

The housing 1 receives therein a piston 3 defining with the housing a space 4 filled with the hydraulic liquid.

The piston 3 has mounted thereabout sealing elements 5, e.g. rubber ring seals.

The housing 1 has mounted thereon a flange 6 limiting the extent of the upward stroke of the piston 3.

The space 4 is communicating via a supply line 7 through a check valve 8 with the source of the hydraulic liquid, which source in the presently described embodiment is a pump 9 supplying the liquid from a reservoir 10.

Another line 11 establishes communication between the space 4 and the drain via a pressure relief or safety valve 12.

This relief valve 12 is set to a pressure corresponding to the maximum effort which the press is permitted to develop (i.e. to the critical load).

To enable adjustment of the stamping or pressing effort of the press, the space 4 is communicating additionally with the drain via another line 13, through an adjustable pressure relief valve 14 which can be of any suitable known per se structure.

The valve 14 is tuned to the pressure corresponding to the effort of stamping or pressing a given work. When another work is to be handed by the press, the valve 14 is retuned to the pressure corresponding to the effort of pressing or stamping that particular work.

In a case when no work has been placed into the lower or female die 15, and the upper or male die is nevertheless driven through its working stroke, there takes place the so-called "cold" impact, i.e. the male die 2 strikes against the female die 15, whereby the maximum load is applied to the components of the press.

In this case the space 4 is to be disconnected from the line 13, which is effected by a specifically provided device incorporating a slide valve 16.

This slide valve 16 is accommodated within the housing 1 in a cylindrical space 17 closed from below with a lid 18.

The space 17 is connected with the space 4 via a passage 19 and also communicates with the line 13 via a passage 20.

The slide valve 16 has cut in the periphery thereof an annular groove 21 which normally establishes communication between the passages 19 and 20.

One end of the slide valve 16 is acted upon by a compression spring 22, while the opposite end of the slide valve 16 carries thereon a rod 23 passing through the lid 18 and projecting beyond the housing 1.

The bed 24 of the press carries thereon a stationary abutment 25 adapted to be engaged by the rod 23, upon the male die 2 having been driven through the maximum length of the stroke, i.e. in a case when no work has been placed into the female die 15.

Herein disclosed hydraulic protection device can be mounted in the bed of the press, carrying the stationary female die, in which case the abutment adapted to engage the rod of the slide valve is mounted on the slide block carrying the male die.

The herein disclosed hydraulic overload protection device operates, as follows.

With the press functioning normally, i.e. when the stan.ping or pressing operation is performed on a work placed in thefemale die 15, the slide valve 16 is in its lowermost position, urged by the spring 22 against the lid 18. In this position of the slide valve 16 its annular groove 21 establishes communication between the passages 19 and 20, i.e. the space 4 communicates with the line 13 incorporating the relief valve 14.

When the slide 1 of the press, which in the presently described embodiment is the housing of the protection device, is driven through its downward working stroke, the male die 2 interacts with a work (not shown) placed in the female die 15.

During this working stroke the effort developed by the drive of the press is transmitted through the piston 3 to the liquid filling the space 4, building up the pressure of this liquid to a corresponding value, this effort being also transmitted through the male die to the work.

If the energy stored by the movable components of the press exceeds the energy required for proper stamping or pressing of the given work, the pressure built up in the space 4 surpasses the adjusted actuating pressure of the relief valve 14.

Therefore, if this is the case, the valve 14 opens, connecting the space 4 to the drain, and the piston 3 moves downward relative to the housing 1, forcing a portion of the liquid filling the space 4 through the line 13 to the drain. Thue, the surplus energy is spent on throttling the liquid under pressure through the relief valve 14, and the stamping or pressing effort would not exceed the rated value.

When the slide of the press is to be subsequently driven through an idle or return stroke, the piston 3, communicated with the drive of the press, moves upward until it abuts against the flange or shoulder 6 and transmits through the latter the effort required to lift the slide 1.

During this idle stroke the space 4 is refilled with the liquid via the line 7 from the supply source 9 through the check valve 8.

In an emergency case, e.g. when no work has been placed into the female die 15, and nevertheless the slide 1 is driven through the working stroke, the slide 1 meets no resistance on the part of the work and, therefore, is driven through a maximum stroke.

In this case the rod 23 engages the abutment 25 and thus drives the slide 16 upwardly, against the effort of the spring 22.

As the slide 16 is thus displaced upward, the annular groove 21 of the slide valve 16 is likewise displaced with respect to the passages 19 and 20, and the cylindrical body of the slide valve 16 closes off communication between the two passages. Thus, the space 4 becomes disconnected from the line 13 and relief valve 14.

When the male die 2 closes upon the female die 15 with no work therebetween, the pressure within the space 4 is rapidly built up, and when this pressure attains the preset critical value, the valve 12 opens, communicating the space 4 with the drain.

The piston 3 now forces the liquid from the space 4 via the line 11 through the now open relief valve 12 to the drain.

In this case the entire energy of the press is spent on throttling the liquid under pressure through the pressure relief valve 12.

As the slide 1 is subsequently driven through the idle stroke, the spring 22 returns the slide valve 16 into its normal position, and the space 4 is refilled with the liquid from the supply source 9.

We claim:

1. A hydraulic overload protection device for a press, adapted to protect this press from overloads upon the movable member of this press, carrying thereon a die, having been driven through the maximum length of the stroke thereof, comprising: a hollow housing; a piston accommodated within this hollow housing; a space defined within said hollow housing by said piston, communicating via a check valve with a source of working liquid and also communicating via a pressure relief valve with a drain, characterized in that said space is additionally communicated with the drain via a line including an adjustable pressure relief valve and a device for disconnecting the said space from the drain upon the movable member of the press, carrying thereon the die, having been driven through the maximum length of its stroke.

2. A hydraulic protection device, as set forth in claim 1, wherein the device for disconnecting said space defined by said hollow housing and said piston from the drain includes a slide valve having an annular groove and accommodated within a space provided in the housing, this last-mentioned space communicating via respective passages with said space defined by said piston and said housing and with said line, one end of this slide valve being spring-urged, and the other end thereof carrying a rod adapted to engage a stationary abutment upon a fixed member of the press, carrying a die, the movable member been driven through the maximum length of its stroke.

* * * * *